United States Patent [19]

Grandis

[11] Patent Number: 4,987,659

[45] Date of Patent: Jan. 29, 1991

[54] SPRING CLIP

[76] Inventor: Stanley Grandis, 1595 Lands End Rd., Manalapan, Fla. 33462

[21] Appl. No.: 511,041

[22] Filed: Apr. 19, 1990

[51] Int. Cl.[5] ..... A44B 21/00

[52] U.S. Cl. ..... 24/499; 24/503

[58] Field of Search ..... 24/499, 500, 501, 502, 24/503, 511, 59, 49 A, 49 CC; 63/14.3, 14.5

[56] References Cited

U.S. PATENT DOCUMENTS

| | | | |
|---|---|---|---|
| 2,021,200 | 11/1935 | Placco | 24/499 |
| 2,583,988 | 1/1952 | Ballou, Jr. et al. | 63/14.5 |
| 2,733,491 | 2/1956 | Saccoccio | 24/499 |
| 2,743,498 | 5/1956 | McVinney | 24/499 |
| 2,764,881 | 10/1956 | Evans | 63/14.5 |
| 2,841,853 | 7/1958 | Guyot | 24/499 |
| 2,853,761 | 9/1958 | Kettell et al. | 24/499 |
| 3,159,894 | 12/1964 | Haug | 24/499 |
| 3,267,694 | 8/1966 | Ficocelli | 63/14.5 |
| 3,597,813 | 8/1971 | Takahashi | 24/499 |

*Primary Examiner*—Victor N. Sakran

*Attorney, Agent, or Firm*—Oltman and Flynn

[57] ABSTRACT

This spring clip for a clip-on article has a flat, generally T-shaped first clip member with openings in its wider end to receive the prongs of staples for attaching it to the clip-on article and laterally outwardly-protruding tabs on its opposite side edges near its opposite end, and a bowed second clip member with apertured ears on its concave side which pivotally receive the tabs on the first clip member, pointed prongs on its concave side facing the first clip member, and a leaf spring member bearing against the opposite end of the first clip member and preventing the clip members from coming apart at the tabs and apertured ears.

6 Claims, 1 Drawing Sheet

SPRING CLIP

SUMMARY OF THE INVENTION

This invention relates to a spring clip for a clip-on article.

Typically, spring clips for clip-on articles are of easily assembled, inexpensive construction and have a first clip member that is directly attachable to the clip-on article and a second clip member pivoted to the first clip member and releasably engageable with the article on which the clip-on article is to be mounted. As one example, the clip-on article may be an ornamental bow and the article on which it is to be mounted may be a lady's shoe. For ease of assembly and to minimize cost, the pivotal connection between the first and second members of the spring clip is designed with enough "play" or looseness between the parts to enable manual snap-in assembly. This design characteristic sometimes results in the clip coming apart inadvertently. The present invention overcomes this problem.

A principal object of this invention is to provide a novel spring clip having separate first and second clip members that are pivotally adjustable between a closed clamping position and an open release position, and a spring segment that prevents the clip members from coming apart inadvertently.

Another object of this invention is to provide a novel two-piece spring clip having a first clip member with laterally outwardly projecting tabs along its opposite side edges, and a second clip member with apertured ears for snap-in attachment to these tabs to couple the clip members pivotally to one another and a leaf spring segment to prevent the first and second clip members from coming apart inadvertently.

Preferably, a spring clip according to the present invention has:

(1) a flat, generally T-shaped first clip member with openings in its wider end to pass the prongs of one or more staples for attaching it to a clip-on article and tabs projecting laterally outward from its opposite side edges near its opposite end; and (2) a bowed second clip member having apertured ears which pivotally receive the tabs on the first clip member, pointed prongs on its inner concave face for biting engagement with the article on which the clip-on article is to be mounted, and a leaf spring segment bearing against the aforementioned opposite end of the first clip member to prevent inadvertent separation of the apertured ears on the second clip member from the tabs on the first clip member.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminolgy used herein is for the purpose of description and not of limitation.

DETAILED DESCRIPTION

Figure 3:
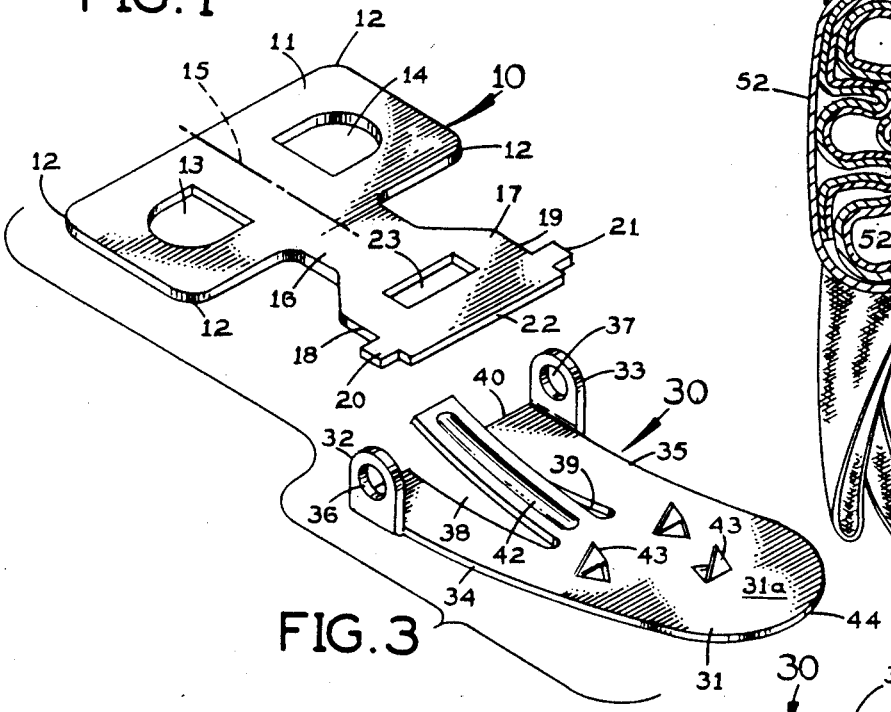
FIG. 3 is an exploded perspective view of the present spring clip.
Figure 4:
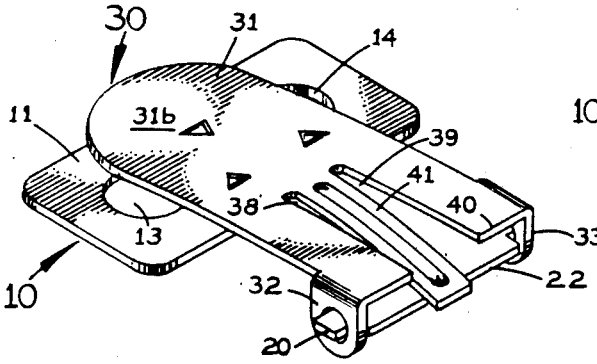
FIG. 4 is a perspective view of the spring clip in its closed position.
Figure 5:
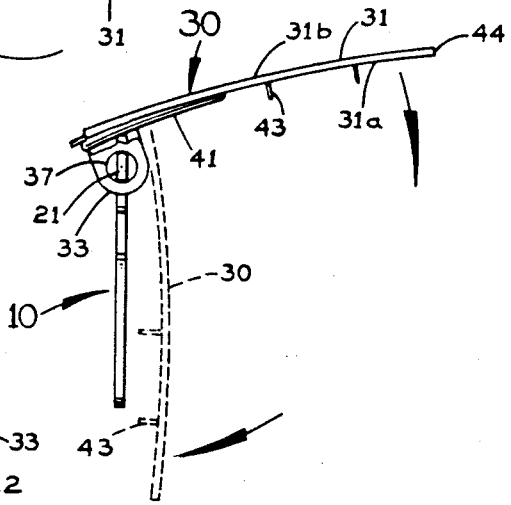
FIG. 5 is an end elevation of the spring clip showing it in full lines in its open position and in phantom in its closed position.

Referring to FIGS. 3–5 the present spring clip has a first clip member 10 and a second clip member 30 pivotally coupled to each other for manual adjustment between a closed position (FIG. 4) and an open position (full lines in FIG. 5).

The first clip member 10 is a flat rigid plate of metal or suitable plastic and is generally T-shaped in outline. At one end it presents a wide segment 11 of generally rectangular shape except for four rounded corners 12 and two generally D-shaped openings 13 and 14 symmetrically located on opposite sides of the longitudinal centerline 15 of first clip member 10. A neck 16 of reduced width extends from the wide end segment 11 to an opposite end segment 17 having opposite side edges 18 and 19 extending parallel to the centerline 15 and on opposite sides of it. Rectangular tabs 20 and 21 project laterally out from the opposite side edges 18 and 19 close to the end edge 22 of the first clip member away from its wide end segment 11. End segment 17 is formed with a rectangular opening 23 which is elongated on opposite sides of the longitudinal centerline 15.

The second member 30 of the spring clip has a base 31 of bowed (concavo-convex) curvature, with a concave inner major face 31*a* and a convex outer major face 31*b*.

At the left end in FIG. 3, the second clip member 30 has ears 32 and 33 extending substantially perpendicularly from the base 31 at its opposite side edges 34 and 35. These ears have circular openings 36 and 37, the diameter of which is just slightly greater than the larger cross-sectional dimension of the tabs 20 and 21 on the first clip member 10. Ears 32 and 33 are on the concave inner side of base 31.

At this same end the second clip member 30 has narrow slots 38 and 39 which are open at the end edge 40 of base 31 and are elongated lengthwise of the base on opposite sides of its longitudinal centerline. A leaf spring arm 41 of the second clip member 30 is joined integrally to its base 31 between the inner ends of slots 38 and 39. When unstressed, as shown in FIG. 3, the leaf spring arm 41 extends on the concave inner side of base 31 and its free end is about as far from the base on this side as the innermost edges of the apertured ears 32 and 33 on this side of the base. Leaf spring arm 41 has a hollow rounded rib 42 along most of its length for strengthening purposes.

Three pointed prongs 43 are struck from the base 31 and they project on its concave inner side. These prongs are located between the slotted end of base 31 and its rounded opposite end edge 44.

FIG. 4 shows the two clip members 10 and 30 of the spring clip pivotally coupled to each other and in the closed position of the clip. The tab 20 on the first member 10 of the clip extends out through the aperture 36 in ear 32 of the second clip member 30, the other tab 21 on the first clip member extends out through the aperture 37 in ear 33, the second clip member 30 extends close and generally parallel to the first clip member 10 with the prongs 43 on the second clip member pointing toward the first clip member, and the leaf spring arm 41 of the second clip member is flexed or resilently deformed from its normal curvature by its engagement with the inner face of the first clip member 10 at the latter's end edge 22.

FIG. 5 shows the second clip member 30 in phantom in this same closed position and shows it in full lines in its open position, which is slightly more than 90 degrees from its closed position. In this open position the second clip member 30 remains pivotally coupled to the first clip member 10, with its apertured ears 32 and 33 continuing to receive the tabs 20 and 21 on the opposite sides of the first clip member. In the open position the second clip member 30 extends from the first clip member 10 at an angle slightly greater than 90 degrees, and the leaf spring arm 41 of the second clip member 30 is almost flattened and therefore it is stressed more in this position of the parts than in the closed position.

In all intermediate positions of the second clip member 30 with respect to the first clip member 10 (i.e., all positions between the closed position of FIG. 4 and the full line open position of FIG. 5), the leaf spring arm 41 of the second clip member 30 continues to be stressed by its continued engagement with the first clip member 10.

The spring arm 41 pushes the tabs 20 and 21 on the first clip member 10 against the edges of the openings 36 and 37 in the ears 32 and 33 on the second clip member 30 with enough force to prevent the tabs and ears from becoming separated even though there is a certain amount of "play" between them.

Figure 1:
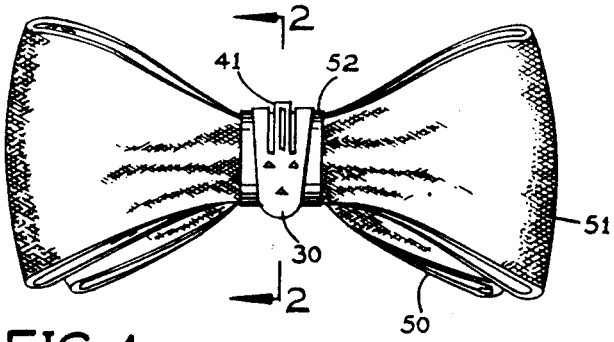
FIG. 1 is a rear elevation of a bow attached to a spring clip according to the present invention.
Figure 2:
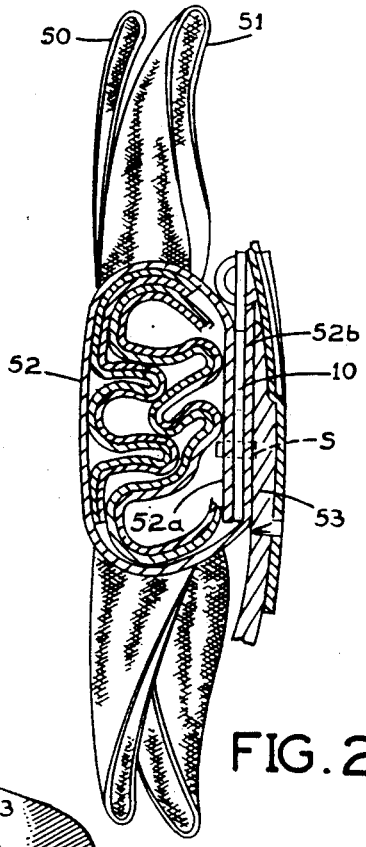
FIG. 2 is a cross-section taken along the line 2—2 in FIG. 1.

FIGS. 1 and 2 show the spring clip of FIGS. 3–5 attached to a clip-on bow, such as for clip-on attachment to a lady's shoe. This bow has a front fabric bow member 50, a rear fabric bow member 51 which may be of contrasting color, and a fabric band or ribbon 52 closely encircling the front and rear bow members at the middle and holding them folded there. As shown in FIG. 2, at the back of the bow the band 52 has overlapping, opposite, flat, end segments **52*a* and 52*b*. The first clip member 10 is sandwiched between these end segments 52*a* and 52*b* and is substantially permanently attached to them by staples S which straddle the middle of the wider end segment 11 of clip member 10 and project through the openings 13 and 14 to penetrate and engage the inner end segment 52*a* of the band. The part of the shoe or other article to which the clip is releasably attached is shown at 53 in FIG. 2 as being engaged between the outer end segment 52*b* of the band 52 in the bow and the base 31 of the second clip member 30, with the pointed prongs 43 penetrating the shoe part 53 to hold the spring clip firmly in place on it. Also, the leaf spring arm 41 urges the pronged half of the second clip member 30 toward the first clip member 10 and thereby maintains a clamping pressure against the shoe part 53**.

I claim:

1. A spring clip for a clip-on article comprising:

a substantially flat first clip member having openings for receiving a fastener to attach said first clip member to the clip-on article, and laterally outwardly projecting tabs on opposite side edges near one end of said first clip member;

and a second clip member having a base with opposite major faces, pointed prongs projecting from one of said major faces for biting engagement with an article on which said clip-on article is to be mounted, apertured ears projecting from said one major face and pivotally receiving said tabs on said first clip member for pivotal adjustment of said second clip member between (1) a closed position in which said base of the second clip member extends close and generally parallel to said first clip member and said prongs extend toward said first clip member and (2) an open position in which said base of the second clip member extends at a substantial angle away from said first clip member, and a leaf spring arm joined at one end to said base and extending therefrom between said ears and bearing resilently against said first clip member to maintain said apertured ears of said second clip member pivotally receiving said tabs of the first clip member.

2. A spring clip according to claim 1 wherein:

said ears on said second clip member have substantially circular openings therein;

and said tabs on said first clip member are substantially rectangular in cross-section and project laterally outward into said openings in said ears.

3. A spring clip according to claim 1 wherein said base of said second clip member is bowed and said one major face of said base is concave.

4. A spring clip according to claim 1 wherein:

said tabs are located near one end of said first clip member;

said prongs are located on a prong-carrying portion of said base away from said ears;

and said spring arm extends from said base in a direction away from said prong-carrying portion of the base and slidably engages said first clip member at said one end thereof, said spring arm being resilently deformed by its engagement with said first clip member to bias said prong-carrying portion of said base toward said first clip member.

5. A spring clip according to claim 4 wherein:

said ears on said second clip member have substantially circular openings therein;

and said tabs on said first clip member are a substantially rectangular in cross-section and project laterally outward into said openings in said ears.

6. A spring clip according to claim 5 wherein said base of said second clip member is bowed and said one major face of said base is concave.

* * * * *